United States Patent [19]

Williams

[11] Patent Number: 4,674,631

[45] Date of Patent: Jun. 23, 1987

[54] SPECTATOR SEAT AND CARRYING CASE

[76] Inventor: Daniel E. Williams, 2424 S. Dixie Hwy., Suite 200, Miami, Fla. 33133

[21] Appl. No.: 853,942

[22] Filed: Apr. 21, 1986

[51] Int. Cl.[4] ..... A47C 13/00

[52] U.S. Cl. ..... 206/216; 297/118; 297/129; 297/217

[58] Field of Search ..... 206/216, 223; 297/1, 297/2, 118, 129, 217

[56] References Cited

U.S. PATENT DOCUMENTS

| | | | |
|---|---|---|---|
| 2,745,466 | 5/1956 | Thompson | 297/129 |
| 3,092,224 | 6/1963 | O'Neil | 297/118 |
| 3,120,404 | 2/1964 | Bramming | 297/118 |

*Primary Examiner*—William Price
*Assistant Examiner*—Jimmy G. Foster
*Attorney, Agent, or Firm*—John Cyril Malloy

[57] ABSTRACT

A spectator seat for optional use either in one mode of assembly as a carrying case for transporting articles to and from a stadium event or the like, such as a parade, or in another mode of assembly as a seat for attachment over a space on a conventional flat backless bench seat and wherein the spectator seat is composed of a seat member of open shell form with hooks extending downwardly from it which are sized and configured for hooked-up engagement with the front portion of a flat bench-type stadium seat, a mating one-piece back member of open shell form and wherein the backrest and seat member are adapted for telescopic interconnection of the backrest member in upstanding relation to the seat member and wherein the device includes orienting surfaces for the two members relative to one another as a carrying case and a locking means to lock the two members into a shell defining relation for use in transporting articles to and from an event.

14 Claims, 7 Drawing Figures

SPECTATOR SEAT AND CARRYING CASE

FIELD OF THE INVENTION

This invention relates to a spectator seat and, more particularly, to a spectator seat which is adapted to be separated into a backrest member and a seat member which can be interconnected in shell defining relation for use thereof as an article carrying device.

BACKGROUND OF THE INVENTION

In the past there have been many types of seats which are developed for attachment at spectator's events, such as to a bench-type stadium seat over an allotted space to a ticket purchaser. This invention is of such a seat; however, the two members, the seat member and the backrest member, in addition to being adapted for telescopic interengagement in seat defining relation, are also adapted to be interconnected to one another so as to define a shell or carrying case in which articles may be transported to and from an event. For example, one attending a parade or a football game may wish to carry binoculars, a portable radio, and a poncho in the event of rain. The carrying case mode of the instant invention adapts the device for carrying such articles. Also, at an event, the backrest member may be telescopically removed from the seat member portion of the spectator seat and utilized as an article carrying tray, all of which is described more fully hereinafter.

OBJECTS OF THIS INVENTION

In accordance with the foregoing, it is an object of this invention to provide a spectator seat for optional use either as a carrying case for transporting articles to and from a sporting event, for example, or in another mode of assembly, at the sporting event, as a seat for attachment over a space on a conventional flat bench-type seat, such as is often found at stadiums and parades and wherein the seat is composed of an open shell form seat member with hooks which are adapted for hooked-up engagement with the bench-type seat over an allotted space and a mating one-piece open shell form backrest member which includes a projecting portion for telescopic interconnection into a recess in the seat member in upstanding relation to define a seat and wherein, for ease in transporting articles, the backrest member may be removed and used as a carrying tray and, finally, when the two members are in confronting and shell defining relation, means are provided for holding the members together so that articles may be carried therein.

It is a general object of this invention to provide an improved structure for a stadium seat which is composed of a removably telescopically interconnectable seat and backrest portion which are adapted for use in assembly as a seat to provide comfortable seating over an allotted space of a bench-type seat at an event or, optionally, for use in transporting articles to and from the event.

In accordance with these and other objects which will become apparent hereinafter, the instant invention will now be described with reference to the accompanying drawings in which:

DETAILED DESCRIPTION OF THE PREFERRED EMBODIMENT

Figure 1:
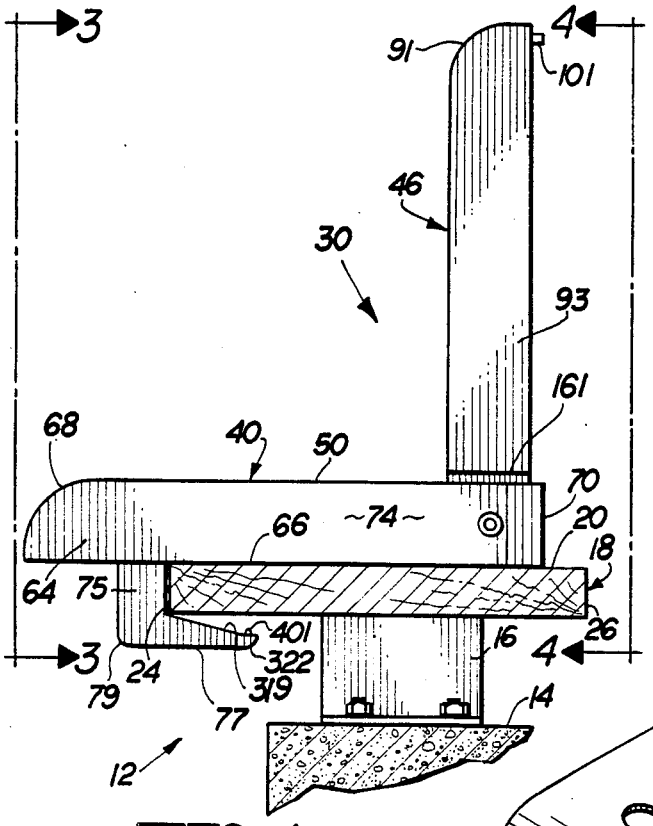
FIG. 1 is a side elevation view, partly in cross-section, and illustrating the spectator seat in hooked-up engagement with a conventional flat backless stadium seat.

Referring to the drawings wherein like reference characters designate like or corresponding parts throughout the several views and referring particularly to FIG. 1, there is shown a generally conventional flat backless stadium seat which is suitably supported for example as by the concrete base 14 and brackets 16. Such seats or really benches are conventionally found in many stadiums. The flat backless seat bench 18, of course has a top 20, bottom 22, and front and rear surfaces 24 and 26 respectively.

The present invention is of a spectator seat with a removable backrest. It is generally indicated by the numeral 30 in FIGS. 1 and 2 and is adapted for optional use either in (a) one mode of assembly as a carrying case for transporting articles to and from a stadium event, see FIG. 6, or (b) in another mode of assembly, as shown in FIGS. 1 and 2, for example, as a seat for attachment over a space on a conventional flat backless stadium seat bench.

Figure 6:
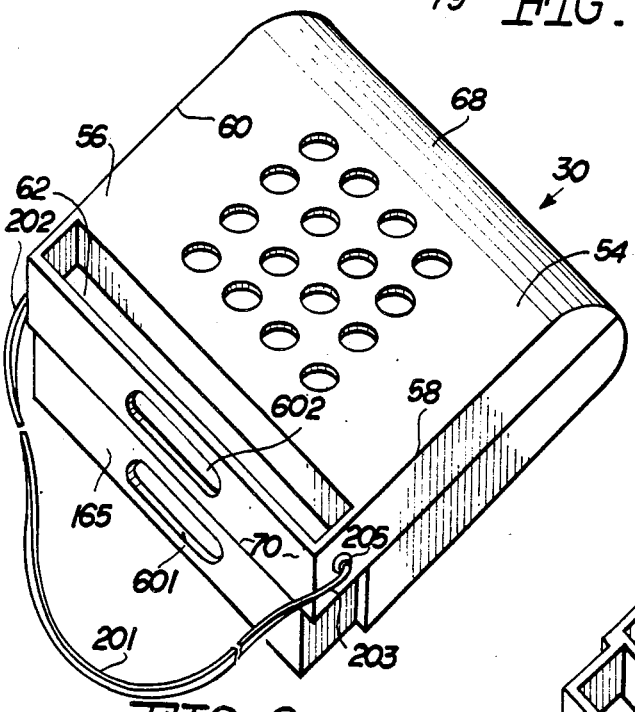
FIG. 6 is a perspective view of the spectator seat when in a mode of assembly as a carrying case for transporting articles to and from a stadium event.

Referring to the instant invention, the spectator seat as is generally indicated by the arrowed line 30, it is seen to be composed of a seat member 40 of open shell form which includes a pair of depending hook means 42 and 44 for hooked-up engagement with the flat stadium seat; and a mating one-piece backrest member of open shell form. These two members, the seat member and the backrest member are provided with mutually intercooperating means for removably and telescopically interconnecting the backrest member in upstanding relation to the seat member, as is illustrated in FIG. 2 and described more fully hereinafter and, additionally, with means for orienting and maintaining those members, that is the seat member and the backrest member, in enclosed shell defining relation for use in transporting articles to and from a stadium event, as seen in FIG. 6.

Referring now particularly to the seat member as opposed to the backrest member, it is seen to be of a predetermined size adapted to fit over the conventional bench seat space which a ticket purchaser is allotted in a stadium or other event, such as a parade stand. It has a seat surface 50 with a lower surface 52, which define a central seat zone bounded by a forward zone 54, a rearward zone 56, and side surfaces 58 and 60 interconnecting those zones. The rear zone 56 of the seat is provided with a recess means 62 of predetermined size located between the edges along the rear zone. The seat is further provided with a downwardly extending continuous peripheral skirt 64 of a predetermined uniform length extending from the lower surface 52 of the seat member to a coplanar or flat terminal end surface 66 generally parallel to and spaced from the seat surface which, in use, rests on the seat bench. The skirt includes a front portion 68, a rear portion 70 and a pair of parallel side portions 72 and 74, the side portions being in confronting relation to one another. In the illustrated preferred embodiment, the rear portion 70 of the skirt, defines the rear wall of the aforesaid recess means 62 while a front wall 73 of this recess means is defined by a septum extending between the parallel side skirt portions 72 and 74 in spaced relation from the rear skirt portion 70. It is in this recess means 62 that a projection on the backrest member is telescopically received as is explained more fully hereinafter.

Figure 2:
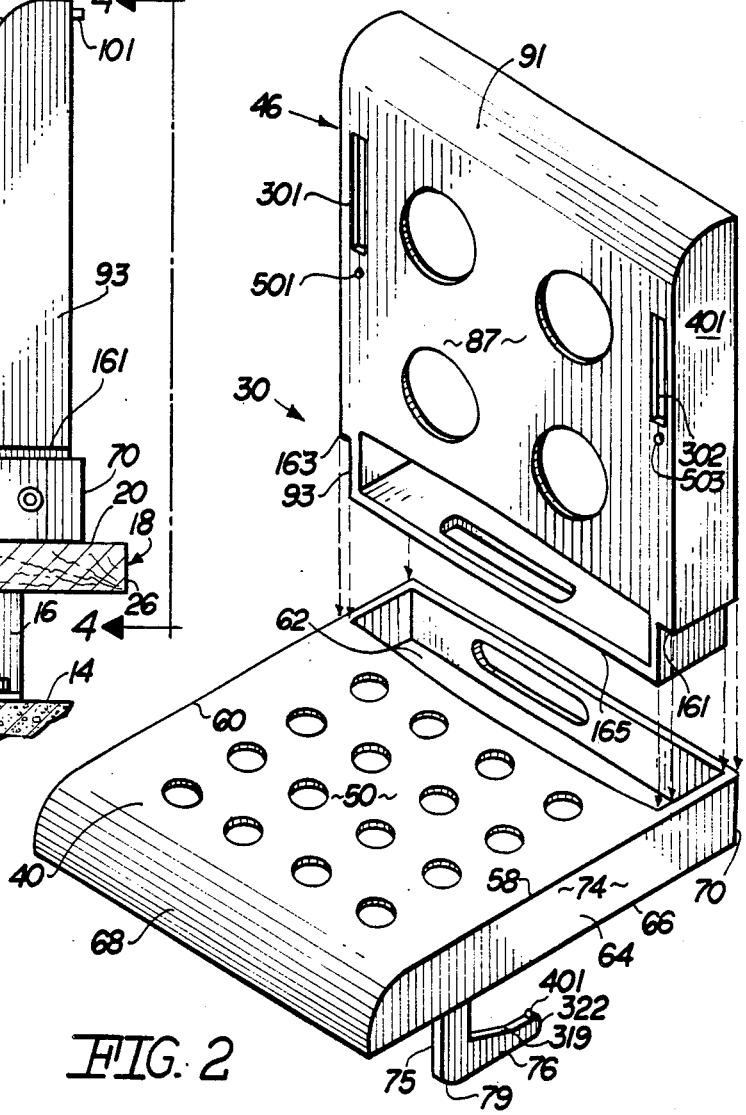
FIG. 2 is an exploded view illustrating the telescopic interconnection of the members comprising the spectator seat when in a mode of assembly for use as a seat at a stadium event.
Figure 3:
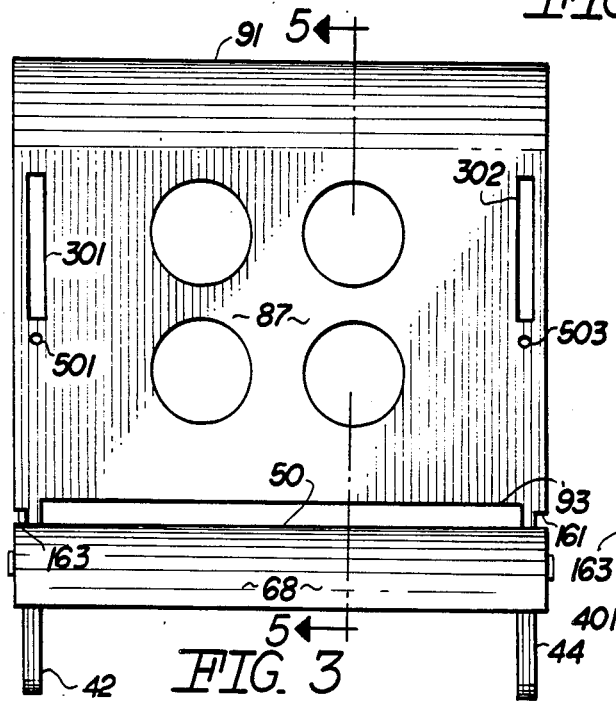
FIG. 3 is a front elevation view of the device shown in FIG. 2.
Figure 4:
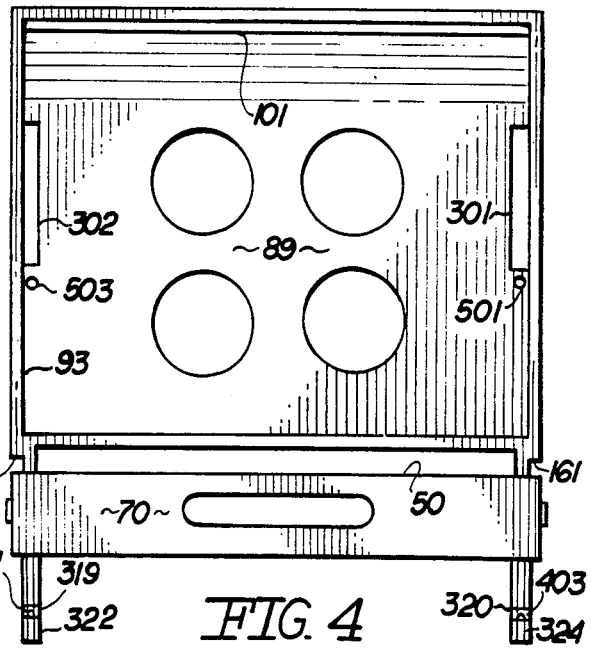
FIG. 4 is a rear elevation view of the device shown in FIG. 2.
Figure 5:
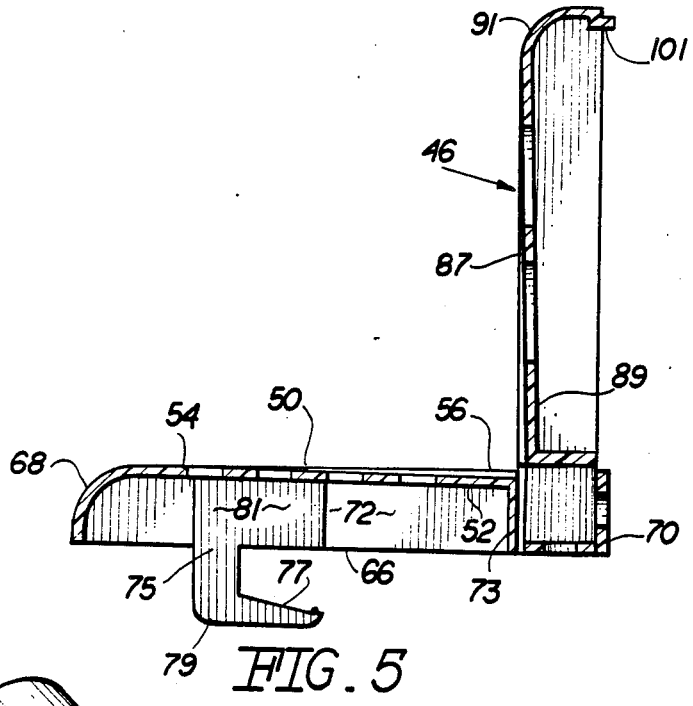
FIG. 5 is a view in cross-section taken on the plane indicated by the line 5—5 of FIG. 3 and looking in the direction of the arrows.

Referring now to the pair of hook means 42 and 44 on the seat member for attachment of it over a bench type stadium seat, as best seen, for example in FIGS. 1, 2 and 5, each is preferably of a common size and shape and includes a first or upper leg portion 75 and a second leg portion 77 defining a crotch zone 79 therebetween. The first leg portion is preferably provided with an enlarged distal attachment pad zone 81 and suitable means such as adhesives, bolts or screws, which secure the pad zone of each of the hooked shaped members to one or the other of the parallel skirt side portion surfaces in opposing relation to one another beneath the forward zone of the seat surface. It is seen that the first leg portion extends from the coplanar terminal end surface of the skirt a distance slightly greater than the thickness of the conventional flat stadium seat, see FIG. 1. Also, the second leg portion of each of the hook means extends from the respective crotch zones rearwardly, that is towards the plane generally of the seat skirt rear portion. This configuration adapts these hook means for hooked-up engagement with a conventional flat stadium seat, as best seen in FIG. 1, with the first leg portion in abutting engagement with the front surface of the flat stadium seat and with the second leg portion being beneath the bottom surface of the conventional stadium seat. This restrains tilting movement of the seat member out of coplanar relation with the top surface of the stadium seat bench when force from a user is exerted against the backrest member as would occur by a seated person.

Referring now to the backrest member designated by the arrowed line 46, it is seen that it has a main backrest surface 87 and a rear surface 89. The main surface is of a predetermined size generally congruent with the seat surface for mating with it as seen in FIG. 6. For purposes of reference hereinafter, the backrest surface has a central zone bounded by an upper and lower zone 91 and 93 respectively and a pair of parallel side portions 94 and 95. It also has a continuous peripheral skirt 401 extending from the main backrest surface a uniform length. As seen at the top right of FIGS. 1 and 5, the distal end of the skirt is stepped, inwardly as at 101, which defines a lip that extends beyond the skirt uniform length. This provides a lip or stop means or locater means. This lip is for orienting the seat member and the backrest member with respect to one another when in registry as seen in FIG. 6 in the mode of assembly for use as a carrying case for transporting articles. To provide a projection means on the backrest member for receipt in the recess means 62, each of the skirt side portions of the backrest are stepped inwardly toward one another adjacent the backrest skirt lower portion as at 161 and 163 in FIG. 2. This defines what may be regarded as a projecting stabilizing nose 165 which is sized, shaped and configured for snug, telescopic insertion into the recess 62 of the seat member in the preferred embodiment between the septum 73, the rear skirt portion 70 and skirt side portions 72 and 74 for assembly of the backrest member and the seat member as seen in FIG. 2, with the backrest member in upstanding relation relative to the seat member.

Preferably, the forward portion 68 of the skirt of the seat member and the upper portion 91 of the skirt of the backrest member are curved away from the main seat surface and the main backrest surface respectively outwardly away from the seat member skirt rearward zone and backrest member skirt wall portion respectively for comfort by the user. In a preferred embodiment, the device also include a carrying strap 201 with opposite ends 202 and 203 suitably secured as by the fastener 205 to the spectator seat. Finally, the backrest member preferably includes a plurality of recesses such as 210, 212 and 214 which are sized for receiving cups of liquid therein, such as soft drinks or other type beverages so that at a stadium event, parade or the like, the backrest may be removed temporarily from telescoping assembly with the seat member and utilized as a carrying tray at an event for refreshments, see FIG. 7.

A preferred means for maintaining the above described two members in the article carrying will now be described. It utilizes the hook means and more particularly, the second leg portion for receipt in companionately sized slots in the backrest member for interconnection of the two members in closed shell orinetation to one another. To this end, the backrest member is provided with a slot such as 301 and 302 in parallel relation to one another located in the central zone of the main backrest, each slot being adjacent to one of the opposite side edges. These opposed slots are each sized and shaped to receive and nest one of the second leg portions 76 and 77 of the hook members therein when the seat back and seat are assembly as a carrying case for transporting articles, as seen in FIG. 6. In the illustrated preferred embodiment, the second leg portion of each of the hooked shaped members, is provided with an inclined upper surface as at 319 an 320 leading to a distal end 322 and 324. This provides not only for accommodation of any variation in the thickness of conventional stadium backless seat benches but also for ease of assembly. Preferably, on the distal end of these second leg portions, detent means 401 and 403 are provided for companionate engagement in detent sockets 501 and 503 of the backrest member. In use for maintaining the seat back and seat member in the article transport mode seen in FIG. 6, the hook members of the seat member are inserted into the slots of the backrest member until the orienting lip 101 nests in abutting relation in and against the skirt so that the detent means are gripped by the detent sockets. For ease in carrying the seat when this is in the mode shown in FIG. 6, the rear skirt portion of the seat member and the skirt lower portion of the backrest member are each provided with a hand opening 601 and 602 so that when the members are assembled as a carrying case for transporting articles, one may insert their hand through those slots to accommodate carrying of the device.

It is seen that in the preferred embodiment, a plurality of holes are provided in the central zone 50 of the seat member 30 for comfort; and it will be realized that a minimum number of parts characterize this spectator seat device and that it is highly useful, convenient and compatible. It is of molded plastic material in the rigid range preferably; however, other rigid materials may be used.

Figure 7:
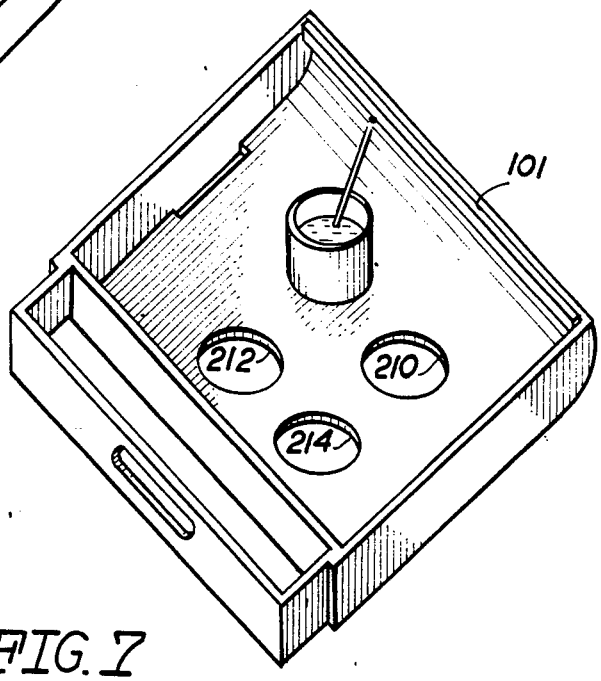
FIG. 7 is a perspective view of the backrest member of the spectator seat when in use as a carrying tray.

In use, it is thus seen that there has been provided a simple and inexpensive device which can be assembled together in either of two modes, one as an attachment for example to a stadium seat to provide a comfortable seat with a backrest or, optionally, as a carrying case for a portable radio, poncho, binoculars or the like, as shown in FIG. 6; and that when in the seat mode, the backrest may be removed to be utilized as a tray, see FIG. 7, for carrying articles purchased at a vending stand for example. The device may be made of metal, plastic, or other suitable rigid materials.

It is contemplated that in a preferred embodiment, the seat member and the backrest member will each be of onepiece molded construction. In such a construction, the skirt may be of double wall thickness for increased rigidity and that reinforcing struts or portions may be provided across the main surface of the backrest and seat member which are within the designs contemplated by the applicant.

While the instant invention has been shown and described in what is considered to be a practical and preferred embodiment, it is recognized that departures may be made therefrom within the spirit and scope of this invention which is, therefore, not to be limited except as set forth in the claims hereinafter and in accordance with the doctrine of equivalence.

What is claimed is:

1. A spectator seat for optional use either in one mode of assembly as a carrying case for transporting articles to and from a stadium event, or in another mode of assembly as a seat for attachment over a space on a conventional flat backless stadium bench seat of the type having a top, bottom, and front and rear surfaces, A. said seat comprising, (a) a seat member of open shell form including hook means sized and configured for hooked-up engagement with the top front and bottom surfaces of the flat stadium seat, (b) a mating one-piece backrest member of open shell form;

(c) mutually intercooperating means on said members for removably and telescopically interconnecting the backrest member in upstanding relation to the seat member when in said another mode of assembly;

(d) means for orienting and holding the members in closed shell defining relation for use in transporting articles when in said one mode of assembly.

2. The device as set forth in claim 1 wherein said mutually intercooperating means comprises recess means in said seat member and projecting means on said backrest member sized, configured and snugly insertable in said recess means.

3. The device as set forth in claim 2 wherein said means for orienting and holding the members in closed shell defining relation comprises an orienting lip extending from one edge of one of said members orienting the members in mating relation with said lip in abutting engagement with a portion of the other of said members.

4. The device as set forth in claim 3 wherein holes are provided in said backrest member for optional use as a carrying tray when said backrest member is separated from said seat member.

5. A spectator seat for optional use either in one mode of assembly as a carrying case for transporting articles to and from a stadium event, or in another mode as a seat for attachment over an allotted space on a conventional flat backless stadium seat bench of the type having top, bottom, front and rear surfaces;

A. said seat comprising, (a) a seat member of open shell form including hook means for hooked-up engagement with the flat stadium seat, (b) a mating one-piece backrest of open shell form;

B. a seat portion comprising, (a) a main seat surface sized to overlay an allotted seat bench top surface, said main seat surface having an upper and lower surface and said upper surface having a central zone bounded by a forward zone, a rearward zone, and a pair of opposed side edges interconnecting said forward and rearward zones, (b) said rearward zone having recess means located between the edges including reinforcing means, (c) a downwardly extending continuous peripheral skirt of predetermined uniform length extending from said lower surface with a coplanar terminal end surface generally parallel to and spaced from said seat surface, and said skirt including a front portion, and a pair of parallel side portions, each of said side portions having a surface confronting the other, C. said hook means comprising a first and second hook shaped member each including (a) a first leg portion and (b) a second leg portion extending away from said first leg portion and defining a crotch zone between the leg portions, (c) said first leg portion having a distal attachment pad zone, (d) means securing the pad zone of each of the hooked shaped members to one of said parallel skirt side portion surfaces confronting one another in opposing relation and located beneath the forward zone of the seat surface, (e) said first leg portion extending from the coplanar terminal end surface of said skirt a distance slightly greater than the thickness of a conventional flat stadium seat beneath the top and bottom surfaces thereof, and (f) said second leg portion extending from said crotch zone and first leg portion away from the seat skirt front portion, (g) said hook means being adapted for hooked-up engagement with a conventional flat stadium seat with the first leg portion in abutting engagement with the front surface of a conventional flat stadium seat and with the second leg portion being beneath the bottom surface of said conventional stadium seat to restrain tilting movement of the coplanar terminal end of the skirt of the seat portion out of coplanar relation with the top surface of a conventional flat stadium seat, D. said backrest member comprising, (a) a first main backrest surface, and a rear surface, said surfaces being of a common predetermined size with a central zone bounded by an upper and a lower zone and a pair of opposite side edges interconnecting said upper and lower zones, (b) said backrest member having a continuous peripheral skirt extending from said backrest rear surface and including an upper portion, a lower portion, and a pair of parallel side portions, (c) said upper, lower, and parallel portions being of a uniform length, and (d) said skirt having a distal end zone stepped at said uniform length defining an orienting lip to be received in the skirt of the seat member when said members are in said one mode of assembly as a carrying case for transporting articles, (e) said lower portion of said backrest member skirt including projecting means companionately sized for snug insertion into the recess means of said seat member for assembly in said another mode as a seat for attachment over a space on a conventional flat backless stadium bench seat in orientation of said backrest member in upstanding relation relative to said member; and E. holding means for maintaining said members in mating confronting relation with one another when said orienting lip is received in the skirt of said seat member and said members are in shell defining relation with respect to one another.

6. The device as set forth in claim 5 wherein said reinforcing means includes a rear skirt portion interconnecting said pair of parallel side skirt portions of said seat rest defining the rear wall of said recess means in said seat member and said seat portion includes a septum extending between said parallel side skirt portions and forming a front wall of said recess means in said seat.

7. The device as set forth in claim 6 wherein said skirt side portions of said backrest member are stepped inwardly toward one another adjacent the backrest skirt lower portion defining a stabilizing nose and said projecting means comprises said nose, said nose being companionately sized for snug telescopic insertion into said recess means of said seat member between said septum and said rear skirt portion.

8. The device as set forth in claim 5 wherein said front portion of the skirt of said seat member and the upper portion of said skirt of said backrest member being curved away from said main seat surface and said main backrest surface respectively outwardly away from the seat member skirt rearward zone and said backrest member skirt wall portion respectively.

9. The device as set forth in claim 7 wherein said seat includes a carrying strap and means securing the carrying strap at the opposite ends thereof to said seat.

10. The device as set forth in claim 9 wherein said backrest member includes a plurality of recesses therein for optional use of said backrest member as a carrying tray for cups containing liquid.

11. The device as set forth in claim 5 wherein said backrest member is provided with a slot in the central zone adjacent each of said opposite side edges, each of said slots being sized and shaped to each nest one of said second leg portions therein when in said one mode of assembly as a carrying case for transporting articles.

12. The device as set forth in claim 5 wherein said holding means comprises said second leg portion of each of said first and second hooked shaped members being provided with a detent means thereon and receiving means adjacent each of said slots sized, located and adapted for registry with said detent means when in said mode of assembly as a carrying case for transporting articles to and from a stadium event.

13. The device as set forth in claim 6 wherein an opening is provided in the rear skirt portion of said seat member and the skirt lower portion of said backrest member and comprising carrying means for carrying said members when in said one mode of assembly as a carrying case for transporting articles.

14. The device as set forth in claim 13 wherein said central zone of said seat member is provided with a plurality of holes therethrough.

* * * * *